US007278837B2

(12) United States Patent
Malmberg et al.

(10) Patent No.: US 7,278,837 B2
(45) Date of Patent: Oct. 9, 2007

(54) DAMPER DEVICE FOR A PISTON PUMP

(75) Inventors: Rolf Malmberg, Lund (SE); Torsten Olsson, Hörby (SE); Lars-Göran Persson, Hjärup (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 428 days.

(21) Appl. No.: 10/467,476

(22) PCT Filed: Feb. 11, 2002

(86) PCT No.: PCT/SE02/00225

§ 371 (c)(1),
(2), (4) Date: Jun. 3, 2004

(87) PCT Pub. No.: WO02/064977

PCT Pub. Date: Aug. 22, 2002

(65) Prior Publication Data

US 2004/0208765 A1 Oct. 21, 2004

(30) Foreign Application Priority Data

Feb. 13, 2001 (SE) ..... 01004662

(51) Int. Cl.
*F04B 11/00* (2006.01)

(52) U.S. Cl. ..... 417/540

(58) Field of Classification Search ..... 417/542, 417/313, 540, 312, 301, 568, 543; 137/565.15, 137/565.13
See application file for complete search history.

(56) References Cited

U.S. PATENT DOCUMENTS

| | | | | |
|---|---|---|---|---|
| 2,501,751 | A * | 3/1950 | Aldridge | 137/565.34 |
| 5,797,430 | A | 8/1998 | Becke et al. | |
| 6,053,208 | A * | 4/2000 | Onishi et al. | 138/30 |
| 6,089,837 | A | 7/2000 | Cornell | |
| 6,095,774 | A * | 8/2000 | Tanaka et al. | 417/540 |
| 6,135,734 | A * | 10/2000 | Isozumi et al. | 417/542 |
| 6,223,725 | B1 * | 5/2001 | Onishi et al. | 123/447 |
| 6,254,364 | B1 * | 7/2001 | Onishi et al. | 417/540 |

* cited by examiner

*Primary Examiner*—Anthony Stashick
*Assistant Examiner*—Vikansha Dwivedi
(74) *Attorney, Agent, or Firm*—Buchanan Ingersoll & Rooney PC

(57) ABSTRACT

The invention relates to a damper device for a piston pump. The device includes a partly air-filled, upright tube placed on the inlet conduit of the piston pump, and a partly air-filled, upright tube placed on the outlet conduit of the piston pump. The two upright tubes are interconnected with each other by means of a tube on which a shut-off valve is disposed. Each of the upright tubes is connected to a blower valve, respectively. Both of the blower valves are connected to a common compressed air source. The damper device may be adapted in a simple manner for aseptic operation and/or elevated product pressure.

9 Claims, 2 Drawing Sheets

DAMPER DEVICE FOR A PISTON PUMP

FIELD OF THE INVENTION

The present invention relates to a damper device for a piston pump comprising a partly air-filled, upright tube placed on the inlet of the piston pump, and a partly air-filled upright tube placed on the outlet of the piston pump, both upright tubes being mutually interconnected by means of a shut-off valve.

BACKGROUND OF THE INVENTION

A piston pump is a high pressure pump of the positive displacement variety which substantially consists of a powerful electric motor, transmission mechanism and crank mechanism, as well as a pump assembly with a pump block, valves and a number of plungers or pistons. The rotary movement from the electric motor is converted by means of the transmission mechanism into the reciprocating movement of the pistons.

One common field of practical application for a high pressure pump of the piston type is in a homogenizer. In those cases where the high pressure pump is employed as a homogenizer, the pump block is supplemented with one or more homogenization apparatuses or counter-pressure apparatuses in which the homogenization process takes place.

Homogenization is an often-employed industrial process, above all within the dairy industry, where homogenization is employed for splitting the fat globules in milk and thereby preventing cream setting. Almost all consumer milk is homogenized today. This employment within the food industry entails that extremely stringent demands on hygiene are placed on not only the homogenizers but also all ancillary equipment.

The movement of the piston pump implies that, on the suction side of the pump, a liquid column of product such as milk is to be accelerated on each stroke of the piston. This entails that the product flow will be greatly pulsating and, in order to avoid the risk that this damages the pump and ancillary equipment, it is necessary to provide the piston pump with dampers.

In its simplest form, a damper consists of a partly air-filled upright tube in direct connection to the piston pump. Many homogenizers available on the market feature as standard such dampers on both the suction side and the pressure side of the pump.

In most practical applications, the above-described type of damper is efficient from the point of view of damping, but cannot normally be cleaned in the CIP system of the dairy plant (Cleaning In Place). The upright tube section must be dismounted and washed manually. Nor is such a damper suitable for aseptic applications, since the upright tube is difficult to sterilize in connection with the sterilization of the remaining equipment.

Gradually as such a damper is in operation, the air entrapped in the upright tube will, in due course, be "consumed" by the product flow. It has hitherto not been possible to replenish air while the plant is in operation, but it has instead been necessary to stop production, which has entailed both time losses and losses of product.

Requirements on higher output capacities and longer running times, for example within the food industry, as well as the utilisation of higher pressure on the pressure side of the pump entail that the above-described dampers will attain far too short an operational running time. The air in the upright tubes is consumed rapidly and production stoppages become necessary.

There are also on the market a number of other types of dampers. Membrane dampers display a gas-filled space discrete from the product by the intermediary of a membrane. These dampers are expensive in operation, since the membrane often needs to be replaced. There are also specialist dampers which can be shut off and emptied of product, whereafter the air can once again be replenished. However, this entails not inconsiderable product losses.

Specialist inlet dampers provided with an external steam hat involve many parts which are difficult to clean and which may cause problems with regard to sterility in aseptic plants. Another type of damper is the resonator type which suffers from the drawback of being difficult to clean and thereby not suitable for food applications.

OBJECT OF THE INVENTION

One object of the present invention is to realize a damper which may be employed on both the inlet and the outlet of a piston pump or a homogenizer. The damper may also be adapted to the high pressures which may prevail.

A further object of the present invention is to realize a damper which is fully washable using the washing system which is employed for remaining equipment, i.e. in a dairy plant.

Yet a further object of the present invention is that the dampers may be supplied with fresh air during operation, which contributes in fewer production stoppages and reduced product losses caused by the dampers.

Still a further object of the present invention is that the damper may, in a simple manner, be adapted to aseptic applications.

SUMMARY OF THE INVENTION

These and other objects have been attained according to the present invention in that the damper of the type described by way of introduction has been given the characterising feature that a blower valve is connected to each upright tube, the blower valves being in turn connected to an air supply source.

Preferred embodiments of the present invention have further been given the characterising features as set forth in the appended subclaims.

BRIEF DESCRIPTION OF THE DRAWINGS

One preferred embodiment of the present invention will now be described in greater detail hereinbelow, with reference to the accompanying Drawings, in which.

The accompanying Drawings show only those details and parts essential to an understanding of the present invention, and both piston pump/homogenizer and other equipment included in the plant have been omitted.

DETAILED DESCRIPTION OF THE INVENTION

Figure 1:
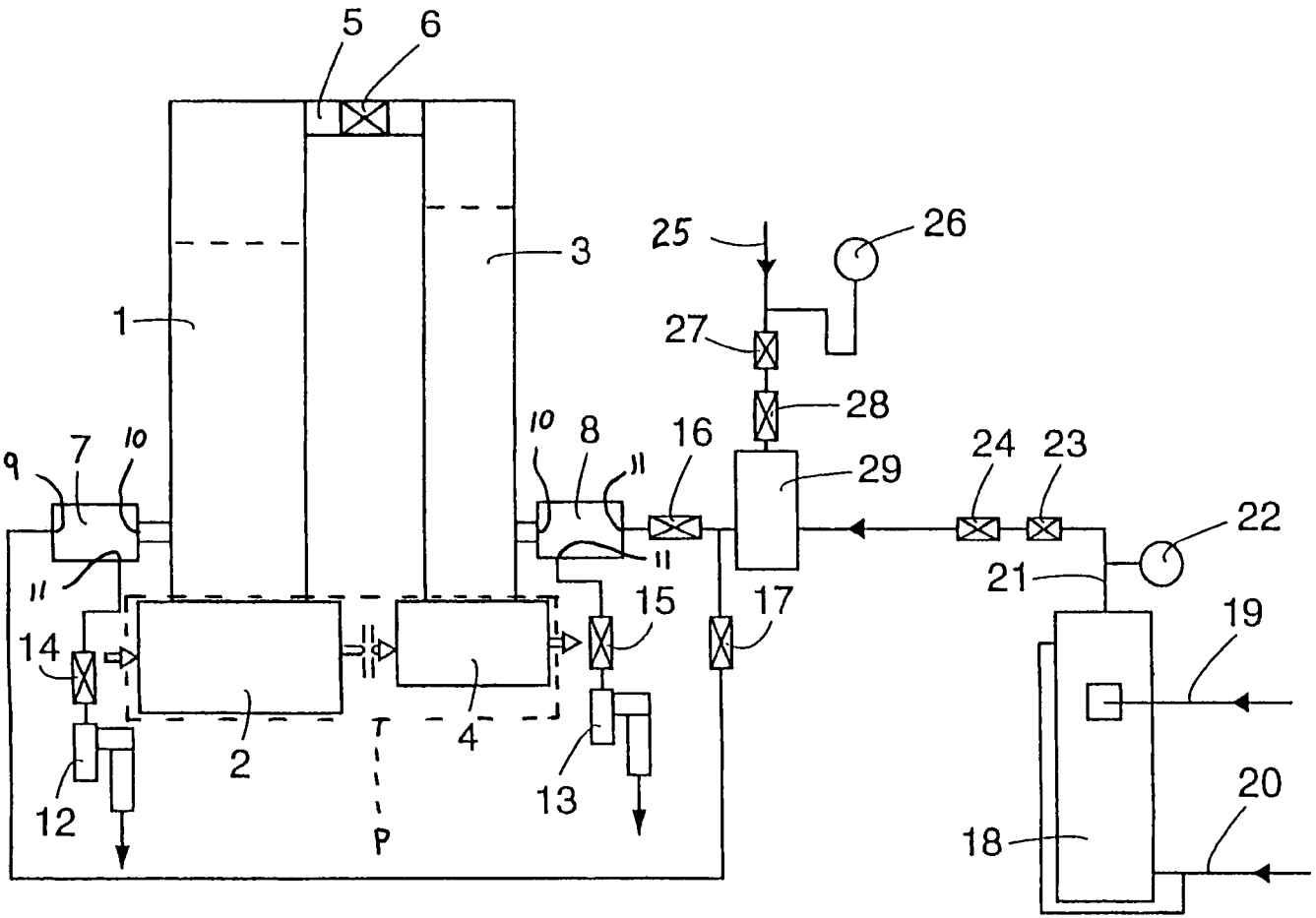
FIG. 1 is a schematic illustration of a damper according to the present invention.

Fig 1 is a schematic illustration of a damper device for a piston pump or a homogenizer (the piston pump or homogenizer is not shown on the Drawings) according to the present invention. The damper device includes a partly air-filled upright tube 1 which is placed on a tube 2 constituting the inlet of the piston pump. The piston pump is generally designated in FIG. 1 as P. The damper device also includes a partly air-filled upright tube 3 which is placed on a tube 4 constituting the outlet of the piston pump. Normally, the damper device is integral with the homogenizer or the piston pump.

The two upright tubes 1 and 3 are interconnected to one another by means of a tube 5 on which a shut-off valve 6 is disposed. The shut-off valve 6 is mounted so that it may serve partly as a safety valve and partly as a valve which may open a communication between the two upright tubes 1, 3. If a stoppage were to occur in the outlet tube 4 of the piston pump, the shut-off valve 6 opens and, in this state, constitutes a safety valve.

The shut-off valve 6 is also opened for washing and for sterilisation. For example, the piston pump or the homogenizer may be included in a dairy plant and is then connected to the washing system of the plant, a so-called CIP system (Cleaning In Place). This implies that both of the upright tubes 1 and 3, the inlet tube 2 of the pump, its outlet tube 4, as well as the tube 5 between the two upright tubes 1 and 3 with the shut-off valve 6 are washed. If the plant is an aseptic plant, the components included in the plant are sterilized prior to production. Sterilisation is put into effect using hot water and in the same manner as the CIP washing.

Figure 2:
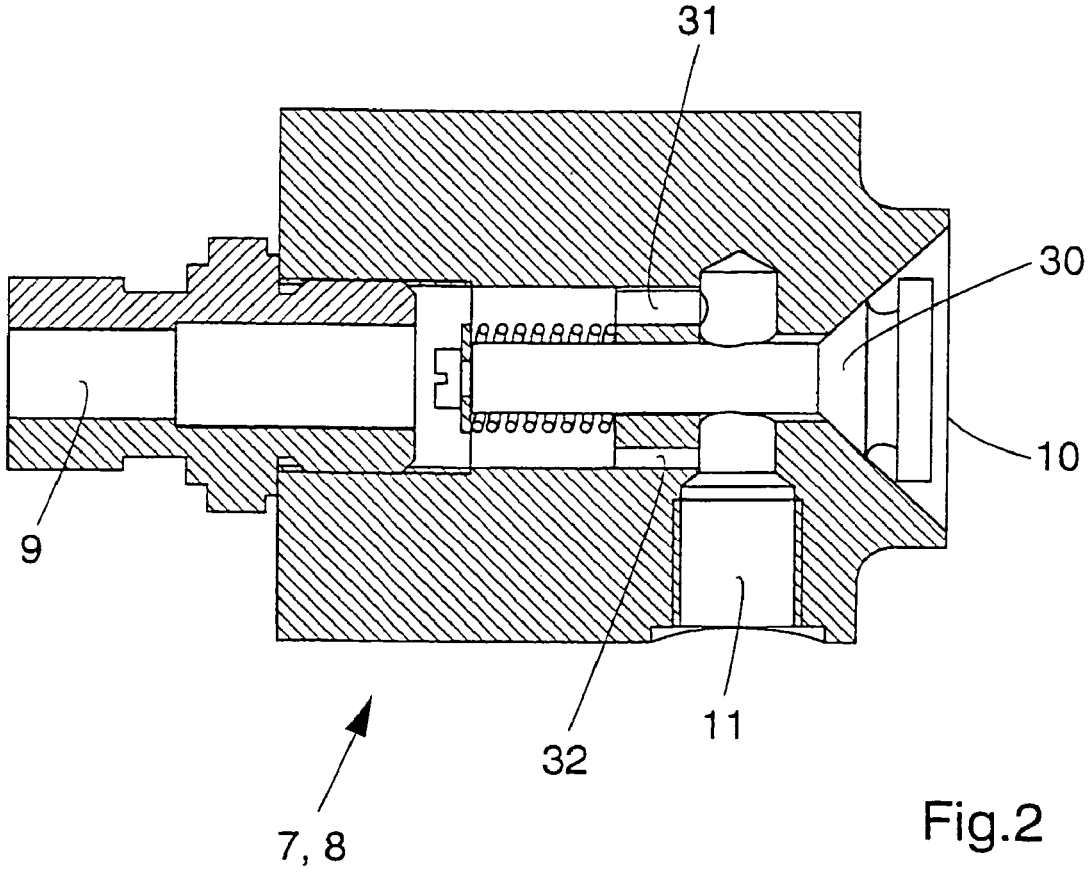
FIG. 2 is, partly in section, a side elevation of a blower valve according to the present invention.

A blower valve 7, 8, respectively is also connected to each upright tube 1, 3. The blower valves 7, 8 may, as in FIG. 1, be placed relatively far down on the upright tube 1, 3, or alternatively may be placed higher up on the upright tube 1, 3. The blower valves 7 and 8 may be designed in the manner which is apparent from FIG. 2.

The blower valve 7, 8 (FIG. 2) has an inlet 9 for air or steam and an outlet 10 connected to one of the upright tubes 1, 3. The blower valve 7, 8 is sealingly connected to an upright tube 1, 3. The blower valve 7, 8 is also connected to some type of overflow valve 12, 13 through an outlet 11. Between each blower valve 7, 8 and the overflow valve 12, 13, there is disposed a shut-off valve 14, 15. The shut-off valves 14, 15 are employed to close the outlet when air is fed to each respective upright tube 1, 3 via the blower valve 7, 8. In those cases when the damper device is employed for low pressure and in a non-aseptic plant, the overflow valves 12, 13 can be replaced by some form of throttle valve or throttle washers.

The inlet of the blower valves 7, 8 is connected to some form of joint compressed air source (not shown). On each inlet conduit, there should suitably be provided a shut-off valve 16, 17 so that one blower valve 7, 8 at a time can be supplied with air. The air in the compressed air source must be pure, food-approved air. Available air pressure from the compressed air source should be approx. 1 bar higher than the highest product pressure in the plant together with which the damper device is employed.

In those cases where the damper device is to be employed for high pressure, a booster 18 is required which compresses the incoming air and ensures that the air pressure into the blower valves 7, 8 will be sufficiently high. The booster 18 has an intake air conduit 19 for control air and an intake air conduit 20 for supply air. On the conduit 21 out from the booster 18, there is suitably provided a pressure gauge 22 and, in those cases where the damper device is to be employed in an aseptic plant, there is also a check or non-return valve 23 and a shut-off valve 24.

In those cases where the damper device is intended for an aseptic application, steam is supplied to the blower valves 7, 8. The ingoing air into the device should maintain a pressure of approx. 1.5 bar in order to ensure aseptic conditions. The steam conduit 25 should suitably be provided with a pressure gauge 26, a check or non-return valve 27 and a shut-off valve 28. The non-return valve 27 is to prevent air from entering into the steam conduit 26 in the same manner that the non-return valve 23 on the air conduit 21 is to prevent steam from entering into the air conduit 21. For an aseptic plant, a sterile filter 29, for example a membrane filter, is also required through which the air passes in its way into the blower valves 7, 8. The sterile filter 29 is kept aseptic by the supply of steam.

The supply of air also takes place at specific intervals whose length may vary and depend upon the process for which the damper device is employed. Alternatively, some form of sensor may be employed for indicating the level of the air entrapped in the upright tube 1, 3. By employing one of the shut-off valves 16, 17 alternatingly, air is fed into one upright tube 1, 3 at a time. The air enters into the blower valve 7, 8 through the inlet 9 and the valve 7, 8 opens into the upright tube 1, 3 in that the valve cone 30 opens the outlet 10. As a result of the design of the valve cone 30, only a narrow gap is opened in to the upright tube 1, 3.

In the event the damper device is employed for high pressure, the shut-off valve 14, 15 should be closed for the outlet 11 and for that blower valve 7, 8 which is in the process of being replenished. In an aseptic plant, the valve 28 for steam supply is closed.

In order to ensure the aseptic conditions when the damper device is employed in a sterile plant, steam must always be supplied to the blower valves 7, 8 when these are not being used for replenishing air to the upright tubes 1, 3. When the air replenishment is completed, the valve 24 for air closes and the valve 28 opens. Both the valves 16, 17 on the inlet conduits to the blower valves 7, 8 and the valves 14, 15 on the outlet conduits must be open. The valve cone 30 of the blower valve 7, 8 closes the outlet 10.

The steam which enters into the blower valves 7, 8 enters in through the inlet 9 and passes through the steam gap 31 in order thereafter to depart from the blower valve 7, 8 through the outlet 11. The blower valve 7, 8 may also be purged of the steam which condenses in the valve 7, 8 through the gap 32.

The overflow valve 12, 13 may consist of a counter-pressure valve, or alternatively a thermodynamic steam trap. By maintaining a certain excess pressure of the steam, an efficient obstacle will be created for ensuring aseptic conditions in the blower valve 7, 8. The overflow valve 12, 13 also serves as a leakage indicator in the event leakage were to occur in the sealing connection 10 to the upright tube 1, 3. The conduits in to the blower valves 7, 8 and the sterile filter 29 being sterile as a result of the supply of steam, that air which is fed to the upright tubes 1, 3 on each replenishment occasion will be sterile.

As will have been apparent from the foregoing description, the present invention realizes a damper device for a piston pump or a homogenizer which may be employed on both the inlet and the outlet to the piston pump, in that the damper device is adapted for the elevated pressures which may occur at the outlet. Furthermore, the damper device is designed so that air may be replenished to the upright tubes during operation, which minimizes production stoppages and thereby reduces any possible product losses caused by dampers. The damper device is well designed for hygienic applications and may readily be adapted for aseptic plants.

What is claimed is:

1. A damper device for a piston pump comprising a partly air-filled, upright tube placed on the inlet of the piston pump, and a partly air-filled upright tube placed on the outlet of the piston pump, both upright tubes being mutually interconnected by means of a shut-off valve, wherein each upright tube is connected to a blower valve, said blower valves being in their turn connected to an air supply source.

2. The damper device as claimed in claim 1, wherein each blower valve has one outlet sealingly connected to the respective upright tube and one outlet connected to an overflow valve.

3. The damper device as claimed in claim 2, wherein the damper device is adapted to aseptic operation by the blower valves and a sterile filter being connected to a supply of steam.

4. The damper device as claimed in claim 3, wherein the air supply is connected to the sterile filter.

5. The damper device as claimed in claim 2, wherein the damper device is adapted for an elevated pressure in that a booster is placed on the air conduit.

6. A piston pump comprising:

an inlet of the piston pump;

an outlet of the piston pump;

a partly air-filled upright first tube on the inlet of the piston pump;

a partly air-filled upright second tube on the outlet of the piston pump;

a shut-off valve interconnecting the upright first and second tubes;

a first blower valve possessing an outlet and an inlet, the outlet of the first blower valve being connected to the upright first tube;

a second blower valve possessing an outlet and an inlet, the outlet of the second blower valve being connected to the upright second tube;

the inlet of the first blower valve and the inlet of the second blower valve being connected to an air supply source;

a first shut-off valve positioned between the inlet of the first blower valve and the air supply source; and a second shut-off valve positioned between the inlet of the second blower valve and the air supply source.

7. The piston pump as claimed in claim 6, wherein the outlet of the first blower valve is a first outlet and the outlet of the second blower valve is a first outlet, said first and second blower valves each comprising a second outlet connected to a respective overflow valve.

8. The piston pump as claimed in claim 6, wherein the inlet of each of the first and second blower valves is connected to a supply of steam.

9. The piston pump as claimed in claim 8, further comprising a sterile filter positioned between the supply of steam and the inlets of the first and second blower valves.

* * * * *